US006860959B1

(12) United States Patent
Rawson et al.

(10) Patent No.: US 6,860,959 B1
(45) Date of Patent: Mar. 1, 2005

(54) NONWOVEN ABRASIVE MATERIAL

(75) Inventors: Neill Rawson, Halifax (GB); Richard Lees, Halifax (GB)

(73) Assignee: SIA Abrasives Holding AG (CH)

( * ) Notice: Subject to any disclaimer, the term of this patent is extended or adjusted under 35 U.S.C. 154(b) by 126 days.

(21) Appl. No.: 10/089,873

(22) PCT Filed: Oct. 4, 2000

(86) PCT No.: PCT/GB00/03799

§ 371 (c)(1),
(2), (4) Date: Apr. 3, 2002

(87) PCT Pub. No.: WO01/24970

PCT Pub. Date: Apr. 12, 2001

(30) Foreign Application Priority Data

| | | |
|---|---|---|
| Oct. 4, 1999 | (GB) | 9923424 |
| Mar. 6, 2000 | (GB) | 0005355 |
| Apr. 14, 2000 | (GB) | 0009332 |
| May 18, 2000 | (GB) | 0012085 |

(51) Int. Cl.[7] ..... B24D 11/02

(52) U.S. Cl. ..... 156/270; 156/250; 156/279; 156/280; 156/296; 264/122; 264/128; 51/293; 51/295; 51/296; 51/307

(58) Field of Search ..... 156/62.2, 252, 156/270, 279–280, 296; 264/122, 128; 51/293, 295, 296, 307

(56) References Cited

U.S. PATENT DOCUMENTS

| | | | | |
|---|---|---|---|---|
| 5,025,596 A | | 6/1991 | Heyer et al. | |
| 5,363,604 A | * | 11/1994 | Heyer | 451/536 |
| 5,685,935 A | * | 11/1997 | Heyer et al. | 156/178 |

FOREIGN PATENT DOCUMENTS

| | | |
|---|---|---|
| EP | 0 562 919 A1 | 9/1993 |
| WO | WO 97/07937 A2 | 3/1997 |

* cited by examiner

*Primary Examiner*—Sam Chuan Yao
(74) *Attorney, Agent, or Firm*—Saliwanchik, Lloyd & Saliwanchik

(57) ABSTRACT

An abrasive material comprises an integral mass of discrete lengths, not bonded to each other, of abrasive-coated non-woven synthetic fibres. In particular, the entanglement force between the said lengths is great enough to maintain a wad of the material when in use but small enough to allow the product to be shaped in the hand of a user.

2 Claims, No Drawings

NONWOVEN ABRASIVE MATERIAL

This application is a National Stage Application of International Application Number PCT/GB00/03799 filed Oct. 4, 2000, published, pursuant to PCT Article 21(2), in English.

FIELD OF THE INVENTION

This invention relates to nonwoven abrasive materials.

BACKGROUND TO THE INVENTION

Nonwoven abrasive materials are well known in the art. Many of these articles are manufactured from polyamide fibres, and include a binder such as phenol-formaldehyde (PF) resin. There are currently a large number of non woven abrasive products in the market place. Most of these articles are made from polyamide fibres (generally Nylon 6 or Nylon 66) and the binder usually employed is phenol-formaldehyde resin (PF). For less aggressive products, polyester fibres and acrylic binders are often used. Current nonwoven abrasives are used in sheets, pads or discs, or are converted into flap wheels or bias mops etc., all of which require sheet strength and integrity. All have sufficient integrity to exist in the form of a sheet having defined surfaces that retains its shape when used for surface-finishing and cleaning.

Products that do not have such integrity and that may be used for surface cleaning and preparation are typically made of cotton wool or steel wool. These materials differ from nonwoven abrasives in that they contain no mineral abrasive particles and in that the fibres are wholly or substantially natural in the case of cotton wool or metallic in the case of wire wool. In both cases, surface cleaning and preparation are effected by the fibres themselves. In the case of nonwoven abrasives, the surface cleaning and preparation is mostly or entirely a result of the abrasive action of the abrasive mineral grains and/or the binder system contained within the structure. The synthetic fibres are used largely as carriers for these abrasive grains and binders.

SUMMARY OF THE INVENTION

According to a first aspect of the present invention, an abrasive material comprises nonwoven synthetic fibres obtained by breaking down a larger mass of fibres into small individual sections with no bonding between them. These sections may be individual fibres, a number of fibres bound together or thin strips of nonwoven fleece.

According to a second aspect of the present invention, an abrasive material comprises nonwoven, synthetic fibres, wherein the entanglement force between the fibres is great enough to maintain a wad of material when in use but small enough to allow the product to be shaped in the hand of a user.

According to further aspects of the present invention, an abrasive material comprises nonwoven, synthetic fibres, and can be separated in user-defined quantities and/or does not have a planar surface.

According to another aspect of the present invention, a method of manufacturing an abrasive material comprises the steps of:

(i) spraying a nonwoven synthetic fibre fleece with resin and binder;

(ii) spreading the sprayed fleece with abrasive;

(iii) curing the resin; and (iv) passing the resultant material to a fibre-opening machine to wholly or substantially separate the individual fibres from one another.

An alternative to step (iv) comprises shredding the material produced in step (iii).

A material of the present invention is useful in a number of applications, for example, where a highly deformable abrasive material is required.

Advantageously, by contrast to known nonwoven and coated abrasive materials, the novel abrasive material has a low enough tear strength to allow it to be separated into a smaller wad and a high enough tear strength to maintain its integrity as a wad or deformed wad when in use.

By contrast to steel wool, a material of the invention is highly abrasive but much less aggressive to the hand. Another advantage is that it is non-rusting. Another advantage is that it is not as highly flammable as steel wool.

DESCRIPTION OF THE INVENTION

A nonwoven abrasive material of the present invention may be manufactured from components typically found in conventional nonwoven materials. Nevertheless, it has a number of physical characteristics and properties that differ from known materials.

In particular, the novel material comprises synthetic fibres coated with binder and abrasive grain, that are wholly or substantially not bonded to one another. The entanglement force between these fibres is great enough to maintain a wad of material when in use but small enough to allow the product to be shaped in the hand of the user.

The material may be tom apart, in wads, and also shaped, or "crumpled", into a desired form. The product typically does not have a planar surface and, unlike conventional products, cannot easily be converted back to its original form.

The ease with which the material may be tom apart and, in particular, that there is no "directional influence" on the tearing, means that the material may be separated in user-defined quantities. By "no directional influence" is meant that there is no difference in the force required to tear one part of the product from that required to tear any other part. This is a significant improvement, as conventional materials are typically provided in manufacturer-defined quantities.

It will be appreciated that criteria given for the integral strength of a product of the invention may depend on the particular user. It will nevertheless be understood that these criteria are meaningful, for example since the ability to separate a part of the larger mass, to form a wad, without destroying the remainder, is a characteristic of, say, cotton wool. Similarly, it will be evident whether or not a product can or cannot maintain its shape when crumpled.

A preferred process for the production of a nonwoven, synthetic, abrasive material comprises the steps of:

(i) separating and blending fibres;

(ii) carding and cross laying the fibres to form a fleece;

(iii) spraying the resulting fleece with a slurry containing abrasive grain and binder;

(iv) optionally spreading the sprayed fleece with abrasive grain:

(v) drying and curing the binder in an oven; and (vi) passing the resultant material to a fibre-opening machine to wholly or substantially separate individual fibres (or groups of fibres) from one another.

A preferred fibre-opening machine is a willying machine. Other mechanical machines having essentially the same effect will be known to those in the art.

An alternative to step (vi) is shredding the cured material, to produce thin strips of material, e.g. between 2 and 10 mm wide.

It will be evident to one of ordinary skill in the art that alternative methods of preparing nonwoven abrasive material are known. For example, air laying may be used, instead of carding.

The abrasive material is typically constructed from three elements, e.g. using the above described process. The fibres are suitably Nylon 66 or polyester. It will be understood that any synthetic fibres may be used, dependent upon the desired use of the product and the binder system employed. Preferably, the fibre density is between 5 and 200 dtex. Combinations thereof may be used, dependent upon process and product performance requirements. The fibres typically have a staple length of 60 mm. It will be understood that this may vary dependent on product performance and process requirements.

The binder is typically an aqueous PF resin in combination with PA66 fibres, or an acrylic binder in combination with polyester fibres. Again dependent upon product application and process requirements, any binder system may be employed, for example epoxy resins, styrene-butadiene resins or polyurethane.

The abrasive grains are preferably of aluminium oxide or silicon carbide. It understood that other abrasives could be used such as Emery, dependent upon the desired performance characteristics of the product. The size of abrasive grains used is typically between #30 and #1800 grit.

Mineral fillers such as fused alumina silicate may also be used. The size and also the chosen type depending on the process and performance characteristics of the producl.

The following Examples illustrate the invention.

EXAMPLE 1

Staple fibres of 17 dtex Nylon 66 of staple length of 60 mm are opened using a willying machine and 2 disc openers and transported by air to a card. The fibres are then processed through the card to produce a unidirectional fleece. The fleece is then passed to a cross-lapper, to build up layers of fleece to form a batt of fibre weight 30 g/m$^2$.

The fibre batt is sprayed with an aqueous phenol formaldehyde (PF) resin and mineral filler slurry. The components making up the slurry are added together to give a total mix weight of about 800 kg. This is continuously agitated to prevent the contents from settling. The weight ratio of dried resin to filler is 1:3. The slurry also includes a small percentage (<1% wt) of a pigment. Prior to spraying, the slurry solids content is approximately 65% wt. A total of 92 g/m$^2$ is sprayed onto the batt.

#180 Aluminium oxide is then spread on the surface of the batt to a density of 80 g/m$^2$, to produce an abrasive fleece. The resulting fleece is then passed through a forced air drier to dry and cure the resin. The finished weight is 170 g/m$^2$. At this point, the fibres contained within the fleece are bound together with PF resin.

The fleece is then passed through a fibre opening (willying) machine where the bonds between the fibres are wholly or substantially broken. The resulting resin and abrasive coated fibres are then air-transported to a fibre collection bin.

EXAMPLES 2 AND 3

Two further abrasive products were made, using the same fibres, binder and procedure as Example 1. The other characteristics of the Examples are tabulated below.

| 1st Abrasive grain type size | Mineral Filler | Fibre: Binder Ratio | Fibre: 1st abrasive grain ratio | Fibre: Mineral filler ratio |
|---|---|---|---|---|
| Aluminium oxide #180 | Fused Alumina silicate | 2:1 | 1:2.7 | 1:0.7 |
| Aluminium oxide #320 | Fused Alumina silicate | 2:1 | 1:1.3 | 1:0.7 |
| Aluminium oxide #600 | None | 1.9:1 | 1:1.5 | 0 |

What is claimed is:

1. A method of manufacturing an abrasive material, comprising the steps of:

(i) spraying a nonwoven synthetic fibre fleece with a binder;

(ii) spreading the sprayed fleece with abrasive;

(iii) curing the binder; and then, (iv) passing the fleece to a mechanical fibre-opening machine to wholly or substantially separate the fibres from one another.

2. An abrasive material obtainable by a method comprising the steps (i) spraying a nonwoven synthetic fibre fleece with a binder;

(ii) spreading the sprayed fleece with abrasive;

(iii) curing the binder; and then, (iv) passing the fleece to a mechanical fibre-opening machine to wholly or substantially separate the fibres from one another.

* * * * *